US005413085A

United States Patent [19]

Kraeft

[11] Patent Number: 5,413,085

[45] Date of Patent: May 9, 1995

[54] APPARATUS AND METHOD FOR DIRECTING AND CONTROLLING PROPELLED BALLS

[76] Inventor: Robert W. Kraeft, 10581 E. Dorado Ave., Englewood, Colo. 80111

[21] Appl. No.: 271,766

[22] Filed: Jul. 7, 1994

[51] Int. Cl.[6] ..... A63B 69/40

[52] U.S. Cl. ..... 124/81; 124/1; 124/56

[58] Field of Search ..... 124/1, 81, 56, 80, 83

[56] References Cited

U.S. PATENT DOCUMENTS 1,198,300 9/1916 Watkins .
1,201,626 10/1916 Reynolds .
2,182,369 12/1939 Barron .
3,018,769 1/1962 Parsoneault .
3,277,878 10/1966 Pankratz .
3,288,127 11/1966 Bullock .
3,640,263 2/1972 Rhodes .
3,838,676 11/1974 Kahelin .
3,930,486 1/1976 Kahelin .
4,021,037 5/1977 Torbet ..... 124/56 X
4,091,791 5/1978 Castelli et al. ..... 124/81 X
4,323,047 4/1982 McIntosh et al. ..... 124/1
5,265,538 11/1993 Otto ..... 124/81

*Primary Examiner*—Dave W. Arola
*Assistant Examiner*—John A. Ricci
*Attorney, Agent, or Firm*—Thomas J. Loran

[57] ABSTRACT

An apparatus and method to direct and control propelled balls by attachment or placement of a guide chute in front of existing or newly manufactured ball pitching machines. If a curve ball is desired, a cantilevered resilient strap is inserted inside the guide chute and positioned to engage the propelled ball, conform to the ball surface shape and induce a ball spin resulting in a curve ball trajectory.

17 Claims, 3 Drawing Sheets

APPARATUS AND METHOD FOR DIRECTING AND CONTROLLING PROPELLED BALLS

BACKGROUND OF THE INVENTION

1. Field of the Invention

The present invention is generally directed to a method and an apparatus that attaches to or is placed in front of existing or newly manufactured ball pitching machines to direct propelled balls and induce any desired ball spin that results in a ball curve during flight or erratic projections after a ball bounce.

2. Description of the Prior Art

For many years there have been ball pitching machines to simulate pitched or batted baseballs and softballs, and tennis ball serves or racket returns of tennis balls. These machines include balls propelled by springs, compressed gasses, elastic members, and rotating devices to impart centrifugal forces that propel balls. These machines are described in U.S. Pat. Nos. 5,123,643; 4,632,088; 4,323,047; 3,989,027; 3,915,143; 3,850,157; 3,640,263; 3,288,127; 3,277,878; 2,182,369, and 1,201,626. Many of these machines also provide various friction methods to induce a spin on the propelled ball that results in a curve ball trajectory. U.S. Pat. No. 2,182,369 uses a spring loaded plunger or friction pad to contact and rub on the ball. In other patents there are similar abrasive and friction devices such as in U.S. Pat. Nos. 5,265,583; 3,930,486; 3,915,143; 3,838,676; 3,640,263; 3,288,127; 3,018,769; 1,201,626, and 1,198,300. The propelled ball slides against rigid surfaces of brake shoes, sand paper, and other rough surfaces providing friction to induce ball spin.

One problem with all the friction methods of producing ball spin by contact on the ball surface relates to abrasion and destruction of the ball surfaces. The centrifugal or rotating wheel devices are especially wearing on balls. This friction and wear problem is exemplified in baseball sales catalogs that advertise baseballs having scuff resistant outer coatings for use in ball pitching machines.

Many of the balls spun by friction induced methods cannot perform similarly to the actual human thrown game balls as indicated by the variety of friction methods used for the past seventy-nine years. Simply applying friction to the outer circumference of a propelled ball many times fails to produce the amount and type of curve that an actual person thrown ball possesses.

The present invention solves these problems by providing straight or induced curve balls to be propelled in a similar manner as a human pitcher without abrasion of the ball. This apparatus also reflects the action of the induced ball spin and erratic ball bounces after tennis racket or ping pong paddle returns, batted ball contact, or kicked balls.

SUMMARY OF THE INVENTION

The present invention generally relates to the attachment or placement in front of existing or newly manufactured ball pitching machines a method and an apparatus to direct propelled balls and also, if desired, to control the ball trajectory by inducing a ball spin.

A guide chute is attached to the discharge position of a ball pitching machine and aligned to permit a propelled ball to freely pass through the center of the chute. If a curve ball is desired, a cantilevered resilient strap is inserted into guide chute. As the propelled ball enters the guide chute, contact is made with the free end of the cantilevered mounted, resilient strap positioned in the center of the ball path. The ball contacts the resilient strap, the strap conforms to the ball shape—similar to a human ball pitcher grasping the ball in a hand with fingers extended. As the propelled ball is released from the strap, a spin is induced on the ball. The resilient strap also causes the ball to strike the inside of the guide chute. This action propels the ball forward with the desired induced curve trajectory—similar to a ball being released by a human pitcher by snapping the arm and wrist to provide proper propulsion after the spin is produced. A resilient layer may be attached on this inner chute surface to enhance ball performance if desired.

The left or right, up or down mounted position of the cantilevered resilient strap determines the direction of the spin and curve of the ball. Mechanisms to insert the resilient strap in desired locations and facilitate the operation of the invention are disclosed. The guide chute is designed for various ball sizes, inducing the curve, or providing no curve to projected balls.

Accordingly, an object of the invention is to provide propelled straight and curved balls similar to human thrown pitched balls.

Another object of the invention is to provide propelled curved balls with little or no damage or abrasion to the ball.

Another object of the invention is to easily adapt the apparatus and method to any ball size such as base balls, soft balls, tennis balls, ping pong balls, soccer balls, volley balls or any other propelled ball.

Another object of the invention is to adapt to any ball pitching machine regardless of the method to pitch balls.

Another object of the invention is to provide an apparatus and method that may easily be adjusted to change the spin direction so to induce the ball to curve in any direction around the axis of a straight propelled ball.

DETAILED DESCRIPTION OF THE PREFERRED EMBODIMENTS

Figure 1:
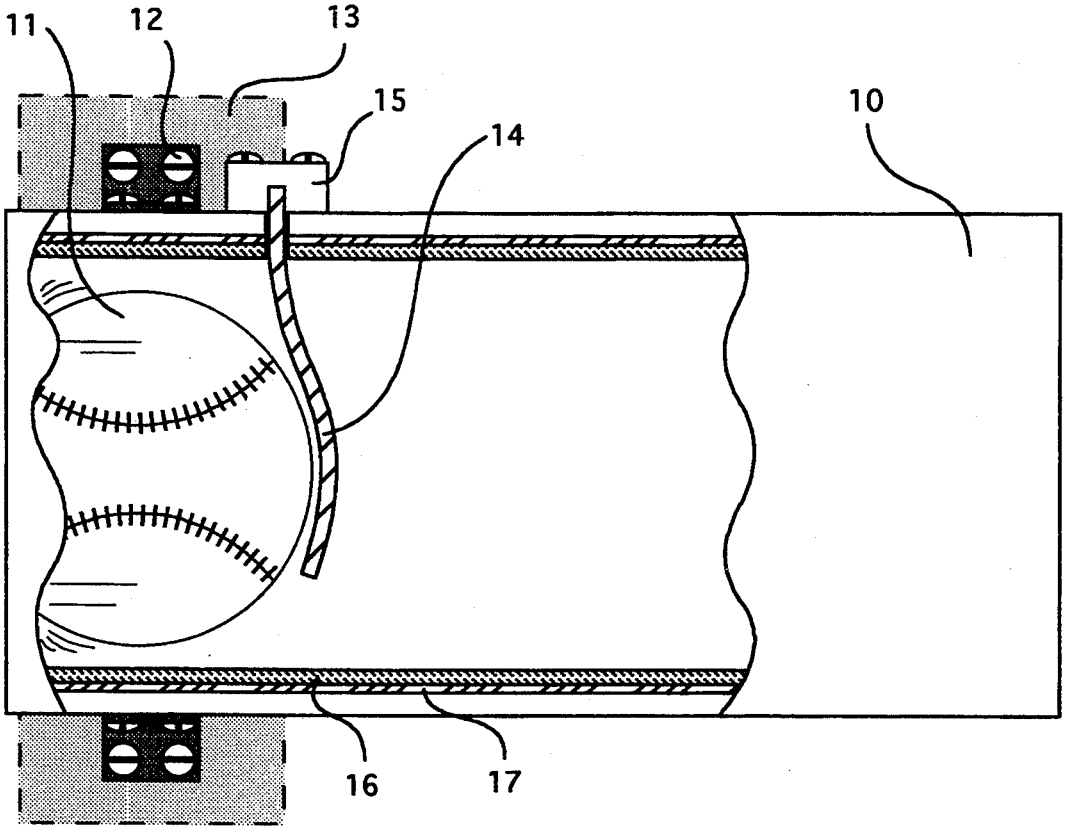
FIG. 1 is a partial sectional top view of the apparatus in an adjusted position to produce a side breaking curve ball to a propelled ball entering the apparatus.

FIG. 1 shows the partial sectional top view of the apparatus for directing and controlling propelled balls having guide chute 10 that mounts to or is positioned in front of the discharge end of any design of ball pitching apparatus. The guide chute is aligned to permit a propelled ball 11 to freely pass through the guide chute center in the propelled ball path. The guide chute cross section may be square, rectangular, round, oval, or multi-sided or combinations of these sections and constructed from wood, metal, plastic, glass, elastomers, or combinations of these materials or any rigid material. Sufficient cross section opening in the guide chute should be maintained to allow a ball to freely pass through the center of the cross section opening. Larger cross sectional openings that accommodate several sized balls may be used, provided the guide chute is positioned to permit the propelled ball to pass through the center of the guide chute. The length of the guide chute is sufficient to mount to a ball propelling device and contain the parts of mechanism that induce a spin and direct the ball. The guide chute may have wall openings or open walls.

The guide chute may be attached to any ball propelling machine permanently as being integrated with the propelling device discharge, or as a separate component with removable or adjustable means 12 such as bolts, screws, friction devices, threads, latches, clips, straps or any holding mechanism. All of these attachments may permit rotation of the guide chute by loosing the attachment and rotating the guide chute around the propelled ball axis or be permanently mounted to produce left and right trajectories of curve balls.

FIG. 1 indicates an attachment to the cross arm 13 of the baseball throwing machine described in U.S. Pat. No. 3,277,878. The apparatus for directing and controlling propelled balls may be placed in front of any ball pitching machine and remain unattached to the ball propelling machine by using self supporting means.

Figure 2:
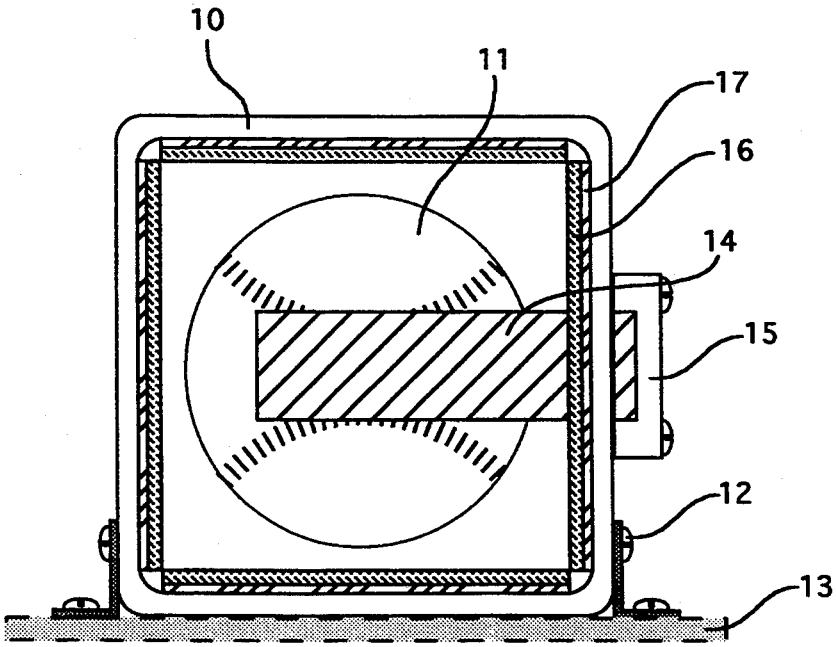
FIG. 2 is a front view of the apparatus from the discharge end that is positioned to produce a side breaking curve as a ball enters the apparatus.

When desiring a curved ball trajectory for the propelled ball, a cantilevered mounted, resilient strap 14 is centrally positioned in the ball path that passes through the guide chute. The resilient strap can be mounted with or without a strap support 15. The free end of the cantilevered resilient strap as shown in FIG. 2 is designed to centrally intercept a propelled ball 11.

The purpose of the resilient strap is to centrally engage the propelled ball in the center of the projected ball trajectory and generally conform to the ball outer surface area curvature thereby grasping the ball. Preferably, the grasping area is the projected ball center line. However, this area can vary from the center line and also produce curve balls. Ideally, the length of the strap extends about 75% across the ball diameter but lesser and greater engagement lengths are possible.

The cantilevered resilient strap or strap support attachment may be fastened directly to the guide chute with screws, rivets, bolts, or any securing means 12. The strap support 15 may be constructed from metal or plastic that is attached to the guide chute. The strap and strap support attachment may be to other means, such as the ball pitching machine frames, or ball pitching machine stand or external supports outside the guide chute, provided the position of the strap free end is maintained centrally to the ball path. This resilient strap 14 may be constructed from resilient elastomers or rubbers, natural or synthetic fibers, plastics, leathers, metals or combinations of these materials. Elastomers such as buna, neoprene or polyurethane are suitable. The resilient strap has varying lengths, widths, and thicknesses depending upon the mass, size, and speed of the propelled ball. For propelled baseballs in the range of 10 to 100 miles per hour, the preferred material is a neoprene elastomer having a durameter range of about 60, length of about 4.8 inches, width of about 1.5 inches and thickness of about 0.13 inches. With resiliency of the strap dependent on the size and construction material of strap, many materials with various dimensions are possible within the scope of the invention.

The location of the resilient strap determines the curve direction of the propelled ball. When observing the ball after being propelled from the apparatus, a right location of the strap in the apparatus will result in a right curve ball. Likewise, a left position will produce a left curve ball. A bottom position results in a dropping ball curve in addition to gravity.

The strap can be positioned in any location 360° rotation around the trajectory of the ball. This can be accomplished by rotating the guide chute or changing the location of the strap in a fixed position guide chute or a combination of both methods.

The ball, grasped by the resilient cantilevered strap, starts a spin upon release from the cantilevered resilient strap and strikes the inner wall of the guide chute as a result of the strap engagement. The guide chute wall provides a propelling thrust to the spinning ball that deflects and directs the propelled ball to the desired trajectory resulting in an induced curve trajectory. An inner protective layer 16, may be attached to the inner guide chute wall to aid the propelling force of the spinning ball and reduce ball wear. This layer may be constructed from resilient natural or synthetic elastomers, natural or synthetic fibers, leathers, plastics or layer material of varying lengths thicknesses and resiliency depending upon the mass, size, and speed of the propelled ball. Elastomers having a durameter of about 40 and thickness of about 0.13 inches are preferred for baseballs and softballs but other combinations of durameter and thickness may be suitable. The layer is attached to the inner wall with adhesives, formed integral with the wall, or attached by mechanical means such as nuts and bolts, clips, screws, rivets, or any other mechanical device or combination. The layer may be attached to a replaceable surface 17 that may be inserted and attached to the inner wall of the guide chute.

With the removal of the cantilevered resilient strap from the inner guide chute, the propelled ball produces a natural trajectory with no induced spin.

Figure 3:
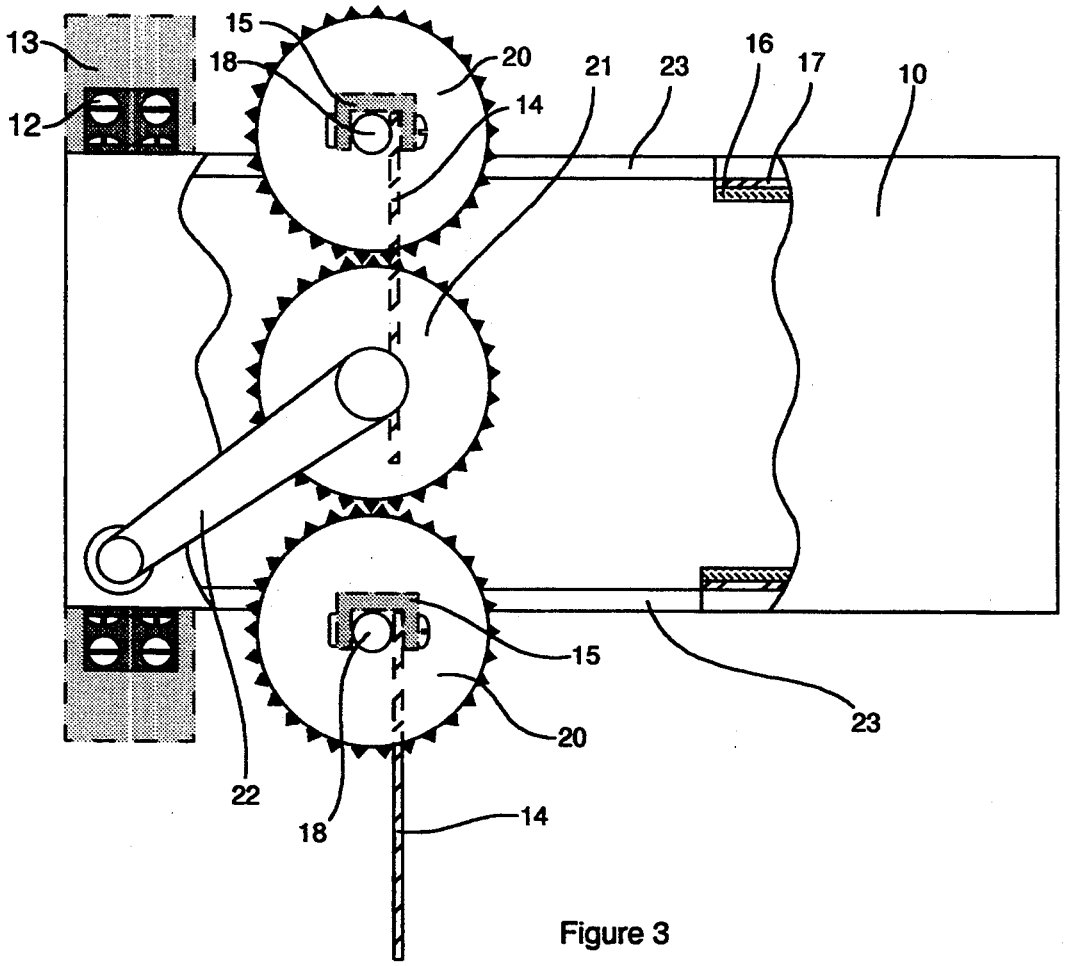
FIG. 3 is a partial sectional top view of the apparatus with a mechanism for inserting a resilient strap to produce a side breaking curve ball.

FIG. 3 shows a partial sectional top view of the apparatus with a mechanism for inserting a resilient strap to produce a side breaking curve ball. This view shows the cantilevered resilient strap 14 attached to one of many automatic means of inserting the strap means into the guide chute 10. The automatic means may be an attachment to any ball pitching mechanism such as the cross arm 13 of the baseball throwing machine described in U.S. Pat. No. 3,277,878. FIG. 3 plan view and FIG. 4 side view show a manual actuation method although hydraulic or electric power may also be used on this and similar designs.

Figure 4:
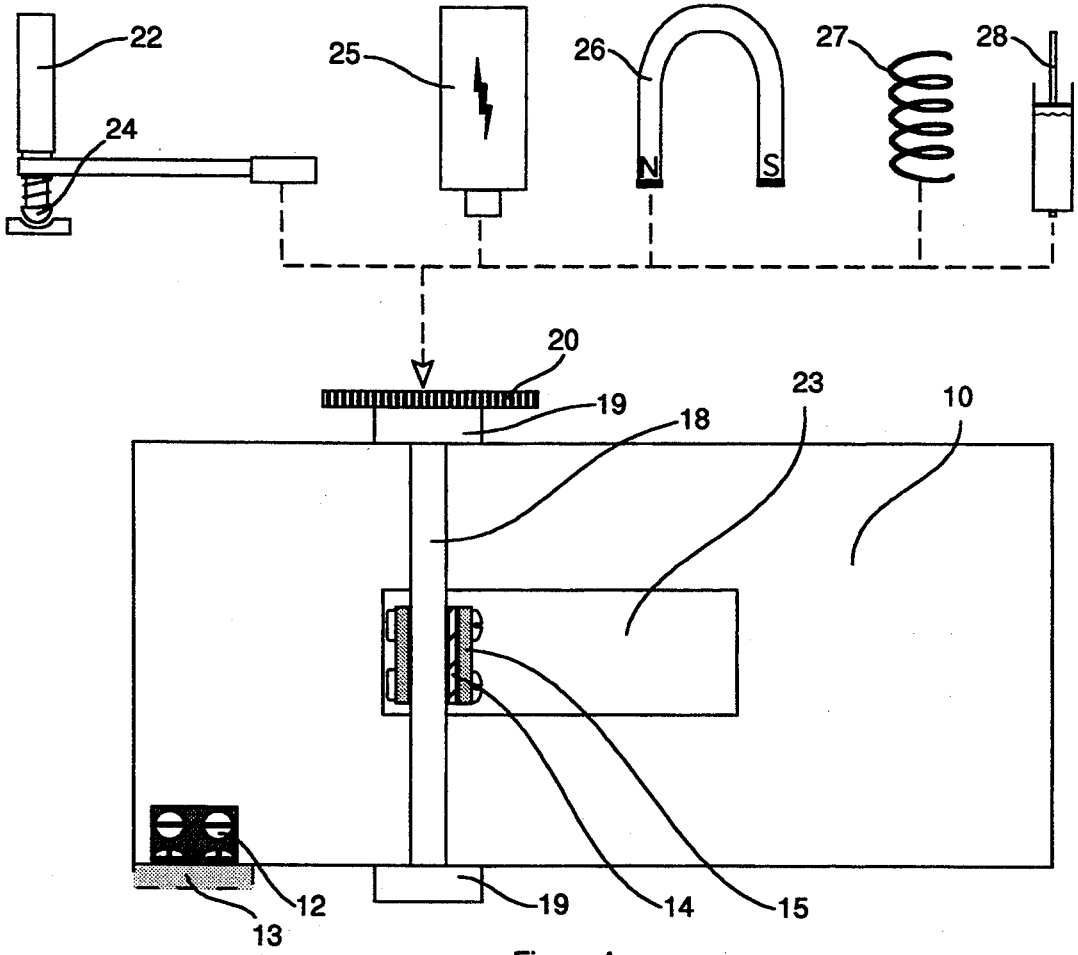
FIG. 4 is a side view of the apparatus with a mechanism for inserting a resilient strap.

In these two FIGS. 3 and 4, two resilient cantilevered straps 14 with supports 15 are attached to spur gear shafts 18, centrally positioned in the gears. These shafts are inserted in bearings 19 that support the two outer spur gears 20 and their shafts. Rotating these two outer gears is a centrally located and supported drive gear 21. A crank 22 is attached to the center of the drive gear. This crank, gear and strap assembly are attached to the guide chute 10 that has wall openings 23 allowing the strap means to be inserted into the center of the chute. The automatic assembly could also be attached to the pitching machine.

The resilient straps are positioned so either one may be inserted into the center of the guide chute causing a propelled ball to curve or neither inserted to provide no curve. With the straps being outside the ball chute, turning the crank in one direction rotates the resilient strap 90° into the guide chute. A spring loaded detent 24 locks the resilient strap in place. Turning the crank in the other direction from the position of no straps in the guide chute inserts the resilient strap into the opposite side.

Figure 5:
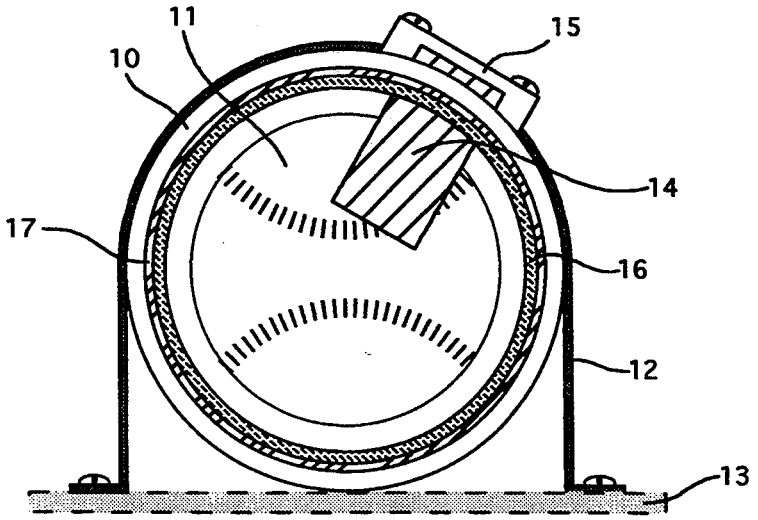
FIG. 5 is a front view of the apparatus from the discharge end showing a lesser ball engagement length by the resilient strap that is positioned on a ball projecting machine so the resilient strap may be placed in any location 360° around the trajectory of the ball.

Any automatic mechanism may include the use of shafts, bearings, pulleys, springs, levers, gears, chains, and wheels or combinations of these parts to insert or control the cantilevered strap. As shown in FIG. 5, the automatic cantilevered resilient strap insertion method actuation may be powered by manual 22, electric 25, magnetic 26, spring 27 and hydraulic 28 power or combinations of these power sources. Electric motor shafts may be directly attached to each resilient strap for insertion into the ball guide chute.

From the above description of the invention, various changes and modifications to the apparatus will occur to those skilled in the art. All such modifications coming within the scope of the appended claims are intended to be included therein.

I claim:

1. An apparatus for directing and controlling propelled balls comprising:

(a) a guide chute means for directing said propelled balls and, (b) a cantilevered resilient strap means for inserting into said guide chute in any of a plurality of desired locations circumferentially around said chute on desire for contacting said propelled balls and conforming to said balls' surface curvature that results in producing a spin on said propelled balls in a direction related to said strap location in said guide chute.

2. The apparatus for directing and controlling propelled balls of claim 1 wherein said resilient strap is composed of material selected from the group consisting of natural and synthetic elastomers, natural and synthetic fibers, leathers, metals, and plastics.

3. The apparatus for directing and controlling propelled balls of claim 2 wherein said synthetic elastomer composition is selected from the group consisting of neoprene, buna, and polyurethane.

4. The apparatus for directing and controlling propelled balls of claim 1 and further comprising a layer attached to an inner wall of said guide chute to reduce said propelled ball wear and aid said ball propelling force.

5. The apparatus for directing and controlling propelled balls of claim 4 wherein said layer is composed of a resilient material selected from a group consisting of natural and synthetic elastomers, natural and synthetic fibers, leathers, and plastics.

6. The apparatus for directing and controlling propelled balls of claim 1 and further comprising an attachment of said apparatus for directing and controlling propelled balls to a ball pitching machine.

7. A method for directing and controlling propelled balls comprising the steps of:

(a) providing a guide chute means for directing said propelled balls and, (b) a cantilevered resilient strap means for inserting into said guide chute in any of a plurality of desired locations circumferentially around said chute on desire for contacting said propelled balls and conforming to said balls' surface curvature that results in producing a spin on said propelled balls in a direction related to said strap location in said guide chute.

8. The method for directing and controlling propelled balls of claim 7 wherein said resilient strap is composed of material selected from the group consisting of natural and synthetic elastomers, natural and synthetic fibers, leathers, metals, and plastics.

9. The method for directing and controlling propelled balls of claim 7 and further comprising the step of attaching a layer to an inner wall of said guide chute to reduce said ball wear and aid said ball propelling force.

10. The method for directing and controlling propelled balls for directing and controlling propelled balls of claim 9 wherein said layer is composed of a resilient material selected from a group consisting of natural and synthetic elastomers, natural and synthetic fibers, leathers, and plastics.

11. The method for directing and controlling propelled balls of claim 7 and further comprising the step of attaching said guide chute means and said cantilevered resilient strap means to a ball pitching machine.

12. An apparatus for directing and controlling propelled balls comprising:

(a) a guide chute means for directing said propelled balls, (b) a cantilevered resilient strap means for inserting into said guide chute in any of a plurality of desired locations circumferentially around said chute on desire for contacting said propelled balls and conforming to said balls' surface curvature that results in producing a spin on said propelled balls in a direction related to said strap location in said guide chute and, (c) a mechanism means for inserting and removing said resilient strap into said guide chute in desired positions.

13. The apparatus for directing and controlling propelled balls of claim 12 wherein said resilient strap is composed of material selected from the group consisting of natural and synthetic elastomers, natural and synthetic fibers, leathers, metal, and plastics.

14. The apparatus for directing and controlling propelled balls of claim 12 and further comprising a layer attached to an inner wall of said guide chute to reduce said ball wear and aid said ball propelling force.

15. The apparatus for directing and controlling propelled balls of claim 14 wherein said layer is composed of a resilient material selected from a group consisting of natural and synthetic elastomers, natural and synthetic fibers, leathers, and plastics.

16. The apparatus for directing and controlling propelled balls of claim 12 wherein said mechanism means for mechanically inserting and removing said resilient strap is powered by force supplied from the group consisting of manual actuation and electric power.

17. The apparatus for directing and controlling propelled balls of claim 13 further comprising an attachment of said apparatus for directing and controlling propelled balls to a ball pitching machine.

* * * * *